US007163004B2

(12) United States Patent
Reiners

(10) Patent No.: US 7,163,004 B2
(45) Date of Patent: Jan. 16, 2007

(54) VENTILATION SYSTEM FOR A FUEL TANK OF AN INTERNAL COMBUSTION ENGINE

(75) Inventor: Frank Reiners, Walblingen (DE)

(73) Assignee: Mahle Filtersysteme GmbH, Stuttgart (DE)

( * ) Notice: Subject to any disclaimer, the term of this patent is extended or adjusted under 35 U.S.C. 154(b) by 143 days.

(21) Appl. No.: 10/499,628

(22) PCT Filed: Dec. 17, 2002

(86) PCT No.: PCT/DE02/04607

§ 371 (c)(1),
(2), (4) Date: Jun. 21, 2004

(87) PCT Pub. No.: WO03/056164

PCT Pub. Date: Jul. 10, 2003

(65) Prior Publication Data

US 2005/0126549 A1 Jun. 16, 2005

(30) Foreign Application Priority Data

Dec. 22, 2001 (DE) ..... 101 63 923

(51) Int. Cl.
*F02M 33/02* (2006.01)

(52) U.S. Cl. ..... 123/519; 123/520

(58) Field of Classification Search ..... 123/516, 123/518, 520

See application file for complete search history.

(56) References Cited

U.S. PATENT DOCUMENTS 3,352,294 A 11/1967 Biller et al.
3,572,014 A 3/1971 Hansen
5,183,023 A * 2/1993 Hanson ..... 123/520
5,347,971 A * 9/1994 Kobayashi et al. ..... 123/520
5,511,529 A 4/1996 Blumenstock et al.
5,669,360 A * 9/1997 Hyodo et al. ..... 123/520
5,878,729 A 3/1999 Covert et al.
5,881,700 A 3/1999 Gras et al.
6,112,728 A * 9/2000 Schwegler et al. ..... 123/520
6,845,652 B1 * 1/2005 Stegmann et al. ..... 73/49.2
2001/0029776 A1 10/2001 Streib

FOREIGN PATENT DOCUMENTS

DE 16 01 423.6-43 5/1972
DE 43 12 720 A1 10/1994
DE 196 20 213 C1 10/1997
DE 196 39 116 A1 3/1998

(Continued)

*Primary Examiner*—Thomas Moulis
(74) *Attorney, Agent, or Firm*—Collard & Roe, P.C.

(57) ABSTRACT

The invention relates to a ventilation system for a fuel tank of an internal combustion engine, the device comprising a filter. The aim of the invention is to functionally improve one such device, simultaneously reducing the structural volume thereof by saving filter volume. To this end, the inventive device is characterized by at least one of the following features: a first stop valve leading to the atmosphere communicates with the same via an air intake filter of the internal combustion engine; and the inner chamber of the tank and the air-guiding region located between the tank and the stop valves are connected to a pump which sucks air from the atmosphere into said region via the air intake filter of the internal combustion engine, if one such pump is available.

6 Claims, 2 Drawing Sheets

FOREIGN PATENT DOCUMENTS

| | | | |
|---|---|---|---|
| DE | 198 29 423 | A1 | 1/2000 |
| DE | 198 44 874 | A1 | 4/2000 |
| DE | 100 18 441 | A1 | 10/2001 |
| EP | 0 733 793 | A2 | 9/1996 |
| EP | 0 955 459 | A2 | 11/1999 |
| JP | 58170845 | A | 10/1983 |
| JP | 02227546 | A | 9/1990 |

* cited by examiner

VENTILATION SYSTEM FOR A FUEL TANK OF AN INTERNAL COMBUSTION ENGINE

CROSS REFERENCE TO RELATED APPLICATIONS

Applicant claims priority under 35 U.S.C. §119 of German Application No. 101 63 923.6 filed Dec. 22, 2001. Applicant also claims priority under 35 U.S.C. §365 of PCT/DE02/04607 filed Dec. 17, 2002. The international application under PCT article 21 (2) was not published in English.

Such a system is known from U.S. Pat. No. 5,878,729 A.

In addition, such a device in which the pump is situated in the section leading from the adsorption filter to the air intake area of the internal combustion engine is described in German Patent DE 198 29 423 A1. With this system, an air intake filter must be connected upstream from the pump on the air intake end, its only function being to filter the intake air to the pump.

The pressure-measuring device used with the generic system serves to test the air carrying region from the interior of the tank to the cutoff valves (when they are closed) for leakage in this area. When a pump is present, this pressure-measuring device is integrated into the pump in particular, so that an excess pressure can be built up by the pump in the aforementioned system in the area to be tested for leakage. When performing the pressure measurement, a medium flows through a fine throttle bore, among other things. This fine throttle bore must be protected from blockage due to soiling, so a filter having a relatively high degree of separation is necessary on the intake side of the pump. The pump itself must also be protected from soiling to a high degree. A high degree of separation also means a high pressure drop and a large filter area if the latter is not to become too great because of this high pressure drop.

This invention is concerned with the problem of managing with the smallest possible number of filters or with filters that do not have a particularly high pressure drop for supplying atmospheric air into the region between the interior of the tank and the closed cutoff valves.

The problem described above is solved with a generic system through the design according to the characterizing feature g of the Patent Claim 1.

Expedient and advantageous embodiments of this invention are the object of the subclaims and are explained in greater detail below on the basis of an exemplary embodiment.

Figure 1:
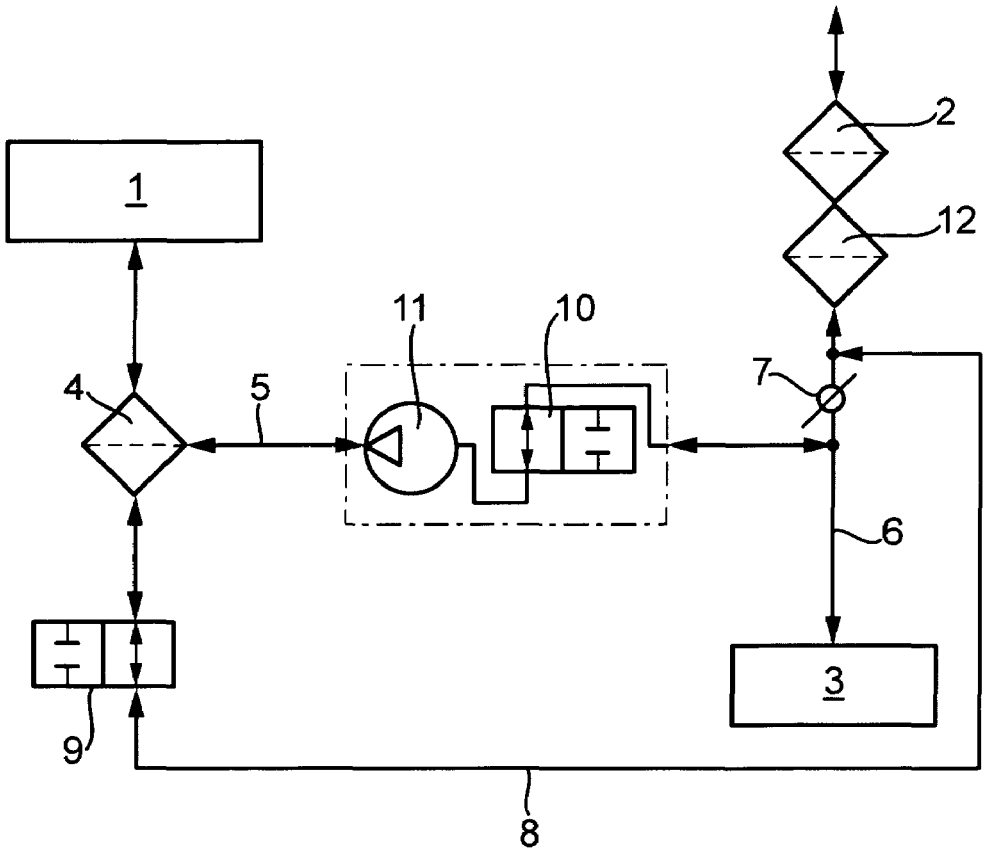
FIG. 1 illustrates a ventilation system for the fuel tank of an internal combustion engine, shown in a schematic diagrams.

A tank 1 is connectable to the atmosphere via an adsorption filter 4 and an intake air filter 2 of an internal combustion engine 3. Between the tank 1 and the adsorption filter 4, which may be an activated carbon filter, valves that are essentially known with tank ventilation systems such as a pressure holding valve (not shown here) which acts with respect to the tank 1, are provided.

The adsorption filter 4 can be backwashed for regeneration by connecting it via a line 5 to the air intake area of the engine 3, which is an area between the intake air filter 2 and the engine 3. With such a backwashing, which is performed at certain intervals and/or when a certain load limit of the adsorption filter is detected, fresh air from the atmosphere is passed through the air filter 2 by means of the intake air into the internal combustion engine 3. In the air intake line 6 of the internal combustion engine 3, there is an intake throttle valve 7 such as those conventionally used with an engine. The fresh air to be introduced from the atmosphere in backwashing the adsorption filter 4 through a flow line 8 via the intake air filter 2 is drawn in upstream from the throttle valve 7 with respect to the internal combustion engine 3. Furthermore, the fresh air is drawn into the air intake line 6 in an area downstream from the throttle valve 7 with respect to the internal combustion engine 3 in backwashing the adsorption filter 4.

The adsorption filter 4, including an area extending into the tank 1, can be cut off airtight with respect to the atmosphere and with respect to the intake line 6 of the internal combustion engine 3 by a first cutoff valve 9 accommodated in the line 8 and a second cutoff valve 10 accommodated in the line 5. Such a cutoff makes it possible to test the air-carrying region for leakage between the tank 1 and the cutoff valves 9 and 10.

One possibility for such a leakage test is to put the respective area under an excess pressure with respect to atmospheric pressure by means of a pump 11 when the cutoff valves 9 and 10 are closed. This space, which is under an excess pressure, can then be tested for leakage by a pressure-measuring device (not shown in the diagram) which may be integrated into the pump 11 and is then connected to the space to be tested. The pump 11 sucks in the air necessary to achieve the excess pressure and to be introduced into the room to be tested from the air intake line 6 at a location downstream from the throttle valve 7.

With respect to the internal combustion engine, an intake air adsorption filter 12 is connected downstream from the air intake filter 2. This intake air adsorption filter 12 may be, for example, a nonwoven material impregnated with activated carbon.

The intake air adsorption filter 12 serves first of all to remove any environmental pollutants from the intake air flowing back out of the air intake filter 2 into the atmosphere when the internal combustion engine 3 is shut down, and secondly, in the case of tank ventilation through the line 8, it provides an additional treatment going beyond that provided by the adsorption filter 4 for the air leaving from the tank 1 into the atmosphere through a downstream additional activated carbon filter. Therefore, the activated carbon filter 4 may either be designed to be of a smaller volume, or with the same design, it may provide an increased reliability with respect to emission of pollutants together with the air escaping from the tank 1 into the atmosphere.

This invention also achieves a substantial advantage when the first cutoff valve 9 is not connected to the intake air line 6 on the atmosphere end. In this case, the first cutoff valve 9 on the atmosphere end is sufficient as a simple valve protection filter if the pump 11 can draw in intake air through the air intake filter 2 and the pressure-measuring device for the leakage test is in the area of the pump 11, i.e., in an area where it is reliably protected by the air intake filter 2 from dirt penetrating from the atmosphere.

A leakage test on the air carrying area between the tank 1 and the cutoff valves 9 and 10 may also be performed without the use of a pump 11 by creating a reduced pressure in this area through the combustion air flowing into the internal combustion engine 3 in an essentially known manner. In this case, the second cutoff valve 10 is also closed after reaching a reduced pressure in comparison with the atmosphere in the space to be tested and then a possible pressure increase is detected as a sign of leakage with a pressure-measuring device which is likewise already known for such a purpose. In the absence of a pump 11, the advantage to be achieved through this invention consists of connecting the first cutoff valve 9 to the atmosphere via an air intake filter 2 combined with an intake air adsorption filter 12.

Figure 2:
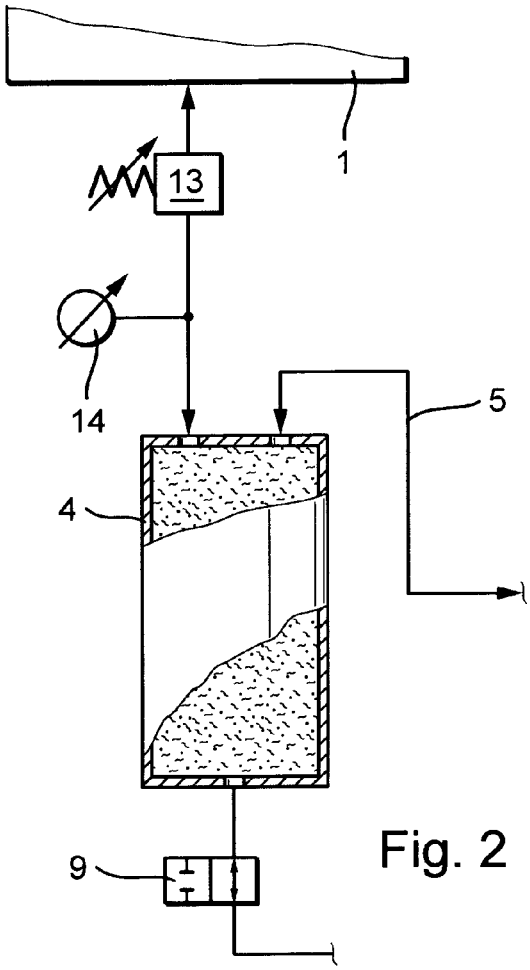
FIG. 2 illustrates a side view of the adsorption filter with cut-open regions from FIG. 1, with adjacent components.
Figure 3:
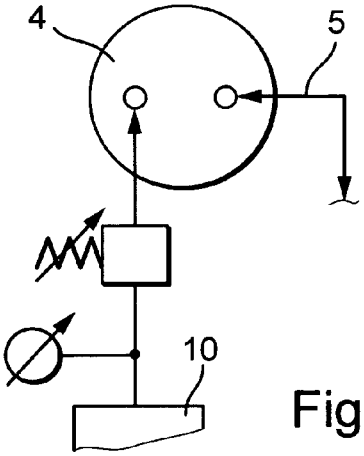
FIG. 3 illustrates a top view from the top of the adsorption filter in FIG. 2. with adjacent components.

As shown in FIGS. 2 and 3, 13 refers to a pressure holding valve that is mentioned in the first paragraph of the description of the figures. 14 refers to a pressure measurement device that is indicated in the fifth characteristic of claim 1.

Figure 4:
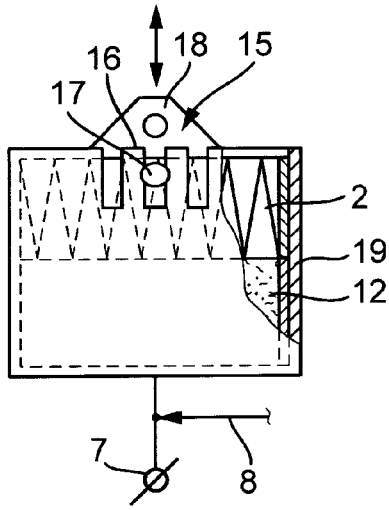
FIG. 4 illustrates a side view of the air intake/air intake adsorption filter from FIG. 2 in integrated construction.
Figure 5:
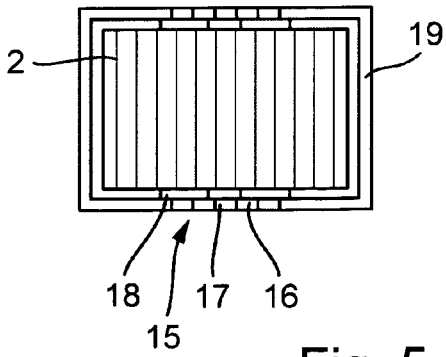
FIG. 5 illustrates a top view of the integrated filter embodiment according to FIG. 4.

As shown in FIGS. 4 and 5, the integrated construction of the filters 2 and 12 is shown therein. The filters 2 and 12 are situated in a common filter housing 19, which is configured to be box-shaped, with an opening on the floor. The intake air adsorption filter 12, and directly adjacent on top of the former, the air intake filter 2, are inserted into the interior of the filter housing 19, directly on the floor. Both filters 2 and 12 are disposed in the filter housing 19 in a releasable manner. The releasability is made possible by means of a snap-in connection 15 between the air intake filter 2 and the filter housing 19. The snap-in connection 15 comprises spring ridges 16 provided on the housing 19, into which a round cam 17 of the intake air filter 2 can be engaged. To release the snap-in connection 15, a handle 18 is provided on the air intake filter 2. When the snap-in connection 15 is closed, the filters 2 and 12 lie tightly in the housing 19 as well as tightly against one another, in the same manner, so that flow occurs through these two filters 2 and 12, one behind the other.

The invention claimed is:

1. A ventilation system for the fuel tank (1) of an internal combustion engine (3), in which a) the ventilation passes through an adsorption filter (4), b) the adsorption filter is regenerable by backwashing with atmospheric air, c) the backwashing air is supplied to the air intake area of the internal combustion engine (3), d) the connections leading from the adsorption filter (4) on the one hand to the atmosphere and to the intake area of the internal combustion engine (3) on the other hand can be interrupted by a first and second cutoff valve (9, 10), e) the interior of the tank (1) and the air carrying area between the tank (1) and the cutoff valves (9, 10) is connected to a pressure-measuring device for determining the pressure inside this entire area containing air when the cutoff valves (9, 10) are closed, f) a pump (11) may be provided in the area carrying the backwashing air between the adsorption filter (4) and the intake area of the internal combustion engine (3), so that with the help of this pump, fresh air from the atmosphere can be introduced into the area between the tank (1) and the cutoff valves (9, 10), comprising at least one of the following features:

g) the first cutoff valve (9) leading to the atmosphere is in a line (8) which leads from the adsorption filter (4) through the air intake filter (2) of the internal combustion engine (3) to the atmosphere, through which a connection to the atmosphere is possible only through the air intake filter (2), h) if a pump (11) is present, it is connected with the atmosphere during intake of fresh air, to be introduced in the region between the tank, on the one hand, and the valves (9, 10) on the other hand, by way of the air intake filter (2) of the internal combustion engine (3).

2. The system according to claim 1, wherein an intake air adsorption filter (12) is connected from the engine air intake filter (2) downstream with respect to the engine intake air flowing through this filter.

3. The system according to claim 2, wherein the intake air adsorption filter (12) is integrated into the intake air filter (2).

4. The system according to claim 2, wherein the intake air adsorption filter (12) is an activated carbon filter.

5. The system according to claim 3, wherein the intake air adsorption filter (12) is designed in the form of a nonwoven material.

6. The system according to claim 2, wherein the intake air adsorption filter (12) is detachably connected to the air intake filter (2).

* * * * *